US006649686B1

(12) United States Patent
Peters

(10) Patent No.: US 6,649,686 B1
(45) Date of Patent: Nov. 18, 2003

(54) WASHABLE SPRAY FORMULATION AND A METHOD OF MAKING THIS FORMULATION

(75) Inventor: Frank Andrew Peters, Coarsegold, CA (US)

(73) Assignee: Duncan Enterprises, Fresno, CA (US)

( * ) Notice: Subject to any disclaimer, the term of this patent is extended or adjusted under 35 U.S.C. 154(b) by 24 days.

(21) Appl. No.: 09/894,425

(22) Filed: Jun. 28, 2001

(51) Int. Cl.[7] ..... C08F 122/10

(52) U.S. Cl. ..... 524/503; 524/513; 252/8.91; 516/7; 516/77; 516/99; 428/323; 428/402; 428/403; 428/407; 222/321.7; 106/15.05

(58) Field of Search ..... 524/503, 513; 516/7, 77; 510/516; 428/402, 403, 407, 323; 424/46, 47; 252/8.91; 239/355, 360, 361; 222/321.7, 630, 631; 106/15.05, 31.04, 31.09, 31.13, 31.23

(56) References Cited

U.S. PATENT DOCUMENTS 5,597,557 A * 1/1997 Kumar et al. ..... 424/70.17
6,106,809 A * 8/2000 Bhatt et al. ..... 424/45
6,194,470 B1 * 2/2001 Lutz et al. ..... 516/7
6,232,392 B1 * 5/2001 Warren et al. ..... 524/513
6,258,764 B1 * 7/2001 Gorlin ..... 510/223
6,455,140 B1 * 9/2002 Whitney et al. ..... 428/212

OTHER PUBLICATIONS

Handbook of Plastics and Rubber Additives, Compiled by Micheal and Irene Ash, Gower Publishing Ltd., 1995, pp. 1981, 1983–1985.*
Krylon Glitter Spray pamphlet, © 1998 KRYLON, 1 page, U.S.A.

* cited by examiner

*Primary Examiner*—Peter D. Mulcahy
*Assistant Examiner*—Satya Sastri
(74) *Attorney, Agent, or Firm*—Stinson Morrison Hecker LLP

(57) ABSTRACT

A washable spray formulation that includes a decorative component is provided. The decorative component may be glitter, pigment, dye, other materials that provide special effects or coloration, or combinations thereof. The preferred embodiment of the spray formulation also includes a solvent that functions as a carrier vehicle, two adhesives, a defoamer, glycol, an amine solvent, and a surfactant. The formulation is able to be pumped through a spray pump.

15 Claims, No Drawings

WASHABLE SPRAY FORMULATION AND A METHOD OF MAKING THIS FORMULATION

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

The present invention relates to a spray formulation containing a decorative component, such as glitter, pigment, dye, or combinations thereof. More specifically, the present invention relates to a spray formulation especially for use on washable fabrics because it can be removed from such fabrics with laundering.

Presently, aerosol glitter sprays are available. They are applied primarily to plants and flowers. One disadvantage with such sprays is that they are not washable and therefore cannot be sprayed on fabrics and easily removed. Another disadvantage with these aerosol sprays is that they contain toxic solvents, and therefore, contact with one's skin must be avoided. Still another disadvantage with such sprays is that they contain propellents, which are extremely flammable. In addition, the aerosol sprays available contain components that tend to settle. Therefore, they usually include a mixing ball therein and must be shaken for several minutes before use plus occasionally during use. Still further, the spray valve of the aerosol can should be cleaned periodically to prevent clogging.

Non-aerosol glitter sprays have also been available. One disadvantage with such pump sprays is that they have a permanent finish and therefore cannot be washed off fabrics easily. Instead, such pump sprays are designed primarily for floral applications. Still further, another disadvantage with previous pump formulations is that they do not suspend glitter adequately. Previous formulations have been bottled in opaque containers to obscure glitter settling and the milky appearance of the base. These formulations also have contained a ball bearing therein to help disperse the glitter when shaken.

In order to overcome these disadvantages, a washable spray formulation is needed. The spray formulation should be able to be sprayed on fabric and then easily washed away by laundering. Preferably, this spray formulation should contain glitter or some other decorative component.

SUMMARY OF THE INVENTION

It is an object of the present invention to provide a washable formulation for decorating fabric so that it can be removed with laundering.

It is a further object of the present invention to provide a formulation that does not separate or settle so that it can be sprayed through a pump without having to be shaken before use.

According to the present invention, the foregoing and other objects are achieved by a washable spray formulation that includes a decorative component. The decorative component may be glitter, pigment, dye, other materials that provide special effects or coloration, or combinations thereof. The preferred embodiment of the spray formulation of the present invention also includes a solvent that functions as a carrier vehicle, two adhesives, a defoamer, glycol, a biocide, an amine solvent, and a surfactant. The formulation is able to be pumped through a spray pump.

Additional objects, advantages, and novel features of the invention will be set forth in the description that follows and in part will become apparent to those skilled in the art upon examination of the following, or may be learned by practice of the invention.

DETAILED DESCRIPTION OF THE PREFERRED EMBODIMENT

The spray formulation of the present invention is designed primarily for spray pump application to fabric. It is readily removable with laundering. It includes at least one decorative component, such as glitter, pigment, or dye. Preferably, it is a water-based non-toxic glitter spray.

The formulation includes a first adhesive, a decorative component, and a solvent. It may further include a second adhesive, a defoamer, a biocide, glycol, an amine solvent, a surfactant, and/or combinations thereof. The formulation is made by adding all of the components together in any order and then mixing the components. If glitter is used in the formulation, the components should be mixed until a homogeneous spray base formulation is formed with the glitter evenly distributed throughout.

The two adhesives in the formulation enable the glitter to adhere to fabric. The first adhesive is an alkali swellable emulsion. It serves as a clear, water-soluble adhesive, as well as a viscosity builder to provide glitter suspension. The adhesive is present in a sufficient quantity so as not to compromise glitter suspension but is not present in so high of a quantity as to increase viscosity such that sprayer atomization is inhibited. Preferably, the adhesive is about 3–4% by weight of the spray base formulation. This adhesive may be Acrysol ASE-60 manufactured by Rohm & Haas, hydrophobe modified alkali swellable emulsions (HASE), or thickeners, such as Acrysol TT-615 and Acrysol TT-935 from Rohm & Haas. Most preferably, the adhesive is Acrysol ASE-60 and is 3.58% by weight of the spray base formulation.

The second adhesive is a clear, water-soluble polyvinyl alcohol (PVA) polymer that is partially hydrolyzed and low in molecular weight. The second adhesive could be removed from the formulation resulting in a moderate, but not complete loss, of adhesion. The weight average molecular weight of the polymer should be between about 13,000 and 146,000. Low molecular weight ensures minimal viscosity build at significant usage quantities and without an adverse impact on spray application characteristics. Preferably, the weight average molecular weight of the polymer is between about 23,000 and 85,000. Most preferably, its weight average molecular weight is between about 31,000 and 50,000. The polymer should be hydrolyzed so as to be substantially water soluble and to ensure that the product will not thicken appreciably over time. The percent hydrolysis of the polymer necessary for sufficient solubility is about 70–96%.

Preferably, the polymer is about 86–94% hydrolyzed. Most preferably, the percent hydrolysis is about 87–89%.

This second adhesive also aids in coating and dispersing the glitter. If present, it is present in sufficient amounts that glitter, metallic pigment, pearlescent pigment, and other pigment adhesion is not compromised but not in such high amounts that spray atomization and product stability suffer. Preferably, the second adhesive is present in an amount of about 5–10% by weight of the formulation. Low molecular weight acrylic, vinyl, or other water-based solution polymers may be used with or in place of the PVA. Most preferably, the second adhesive is Celvol 205S from Celanese, which is pre-mixed 26% by weight polyvinyl alcohol and water, and this adhesive is 5.01% by weight of the spray base formulation.

Preferably, a low volatility amine ($R\text{-}NH_2$) solvent is used in conjunction with the first adhesive to promote polymer clarity, an alkaline pH, and thickening action. If present, the amine is present in sufficient amounts to raise or keep the pH of the formulation at about 7 and not in such high quantities as to raise the pH above about 9. Preferably, the amine solvent is 0.3–0.6% by weight of the spray base formulation. The solvent may also be ammonia or organic compounds containing an amino ($NH_2$) functional group, such as 2-amino-2-methyl-1-propanol. Preferably, the solvent is AMP-95 manufactured by Angus and is 0.48% by weight of the spray base formulation. AMP-95 is preferred over ammonia because it evaporates at a far slower rate, ensuring an alkaline pH for the life of the product. AMP-95 has a vapor pressure of 239 mmHg at 180° F. whereas the vapor pressure for ammonia is 755 mmHg @80° F.

Propylene glycol is employed in the formulation to ensure freeze-thaw stability, glitter wetting, and glitter dispersion. Propylene glycol could be removed from the formulation without adverse effects provided that the formulation is not frozen prior to use. Preferably, the propylene glycol is 90% purity by volume and is obtained from Dow Chemical. The propylene glycol should be present in a sufficient quantity not to compromise freeze-thaw stability but not in such a high amount that the formulation dry time would be unacceptably slow. Preferably, the propylene glycol is about 2–10% by weight of the spray base formulation. Most preferably, the propylene glycol is 2.98% by weight of the spray base formulation. Ethylene glycol, glycerin, or other glycols may be used with or in place of propylene glycol.

A solvent serves as the carrier vehicle for all the components of the formulation. It serves to keep viscosity build from the adhesives to a minimum, and it provides volume in the product to maximize the spacing between glitter flakes, which prevents sprayer clogging. It is present in a sufficient amount to keep the formulation from being too viscous to spray properly but not in such a high quantity so as to be unable to suspend the decorative component. Preferably, the solvent is about 75–90% by weight of the spray base formulation. The solvent may be water, alcohol, or other solvents that may decrease dry time. If alcohol is used, preferably, 70% by weight isopropyl alcohol or 70% by weight denatured ethanol is used. Most preferably, the solvent is water, and it is 87.65% by weight of the spray base formulation.

The decorative component may be glitter, metallic pigments (e.g., aluminum, zinc-copper alloys, etc.), pearlescent pigments (e.g., mica coated with metal oxides), organic and inorganic pigments, FD&C (Food, Drug and Cosmetic) dyes, Drug and Cosmetic (D&C) dyes, and other materials that provide special effects or coloration. Preferably, the decorative component is glitter.

The glitter in the formulation preferably is polyester-coated aluminum. The glitter should be present in sufficient amounts that it is visible when sprayed but not in such a high quantity that sprayer clogging occurs frequently. Preferably, glitter is about 1–3% by weight of the formulation. Most preferably, the formulation is 1.6% glitter by weight and 98.4% spray base formulation by weight. The glitter flakes may be hexagonal, rectangular, square, or other shapes. Preferably, they are hexagonal flakes obtained from Glitterex Corporation, Meadowbrook, or Spectratek. Preferably, the glitter flakes have an effective diameter of about 4 mils or less and a thickness of about 1 mil or less.

If used in the formulation, metallic pigments are present in sufficient quantities to provide metallic luster and opacity but not in such high quantities that pigment crowding occurs leading to sprayer clogging. Gold metallic pigments can be made from alloys of zinc and copper, and silver metallic pigment can be made from inhibited aluminum designed for waterborne coatings. Preferably, if present, metallic pigments are about 1–10% by weight of the entire formulation. Most preferably, they are 5–10% by weight of the entire formulation.

Pearlescent or nacreous pigments may also be used in the formulation. These pigments are platelets of mica coated with various metal oxides that produce a pearl-like luster. They may have a coarse particle size. If used in the formulation, the pearlescent pigment is present in a sufficient amount to create metallic luster and opacity but not in such a high quantity that pigment crowding can occur, leading to sprayer clogging. Preferably, pearlescent pigments are about 1–10% by weight of the entire formulation. Pearlescent pigments manufactured by Engelhard Corporation or E/M Industries may be used in the formulations.

Dyes add aesthetic appeal to the formulation, but are not necessary to achieve the intended effect of the product. If a dye is used in the formulation, it should be present in a sufficient quantity to have an effect on coloring the product but should not be present in such an amount that it can leave a colored residue on fabric even with repeated laundering. Preferably, dyes are 0.001–0.10% by weight of the formulation. FD&C and D&C dyes manufactured by BASF Corporation may be used in the formulation.

The defoamer is a silicone-based compound that prevents foaming of the product in the container and when sprayed. The defoamer is an optional component and could be removed from the formulation with minimal adverse effects. The defoamer may be silicone or silicone-modified mineral oils, such as BYK 022 and 035 manufactured by BYK Chemie and Foamstar A10 and A12 manufactured by Cognis. The defoamer is present in a sufficient quantity to provide antifoaming action but not in such a high amount that film defects such as cratering and "fisheyes" occur. Preferably, it is 0.02–0.20% by weight of the formulation. Most preferably, the defoamer is BYK 022 and is 0.12% by weight of the spray base formulation.

Preferably, a biocide is employed to prevent product spoilage due to microorganisms. When a biocide is added to the formulation, the formulation has a shelf life of at least about one year, and preferably, at least about two years. The biocide is present in an amount sufficient to be effective against microbial contamination yet in less than an amount that can cause skin irritation. Preferably, it is present in an amount of about 0.1–0.2% by weight of the formulation. Examples of biocides include Kathlon LX manufactured by Rohm & Haas, Nuosept 95 or 101 manufactured by Creanova, Troysan 395 manufactured by Troy Chemical, and Proxel GXL manufactured by Avecia. Most preferably, the biocide is Kathlon LX and is 0.18% by weight of the spray base formulation.

Additives such as surfactants, anionic dispersants, and nonionic surfactants could be added to the formulation to enhance performance. However, they could be left out of the formulation with minimal negative impact. If present, a surfactant should be present in an amount to substantially wet the metallic pigment but not in such a high quantity that product separation can occur. Preferably, a surfactant is about 0.5–1.5% by weight of the spray base formulation. The surfactant may be a phosphate ester surfactant. Most preferably, the surfactant is Dextrol OC-15 phosphate ester surfactant manufactured by Dexter Chemical and is about 1.0% by weight of the spray base formulation.

An anticorrosive agent may also be added to the formulation. It should be present in an amount sufficient to have effective anticorrosive properties but not in a quantity so high that crystallization can occur, leading to sprayer clogging. Preferably, it is benzotriazole and is 0.3–0.5% by weight of the spray base formulation. Most preferably, the benzotriazole is manufactured by PPG Industries and is pre-blended with propylene glycol to 10% purity prior to adding to the formula.

The formulation is placed in a container with a pump spray. The pump spray atomizes the formulation resulting in quick and even applications. The formulation does not contain propellants. The pump should have a spray volume of about 160–240 microliters ($\mu$l). Preferably, it has a spray volume of 180–220 $\mu$l, and most preferably, it has a spray volume of about 200 $\mu$l. The spray orifice of the pump has a diameter of about 16–20 mils. Preferably, the spray orifice has a diameter of about 17–19 mils, and most preferably, the spray orifice has a diameter of about 18 mils.

The viscosity of the formulation should be about 2000–3200 centipoise (cps) (spindle 4 @ 10 rpm). Preferably, the formulation's viscosity is about 2200–3000 cps. Most preferably, the formulation has a viscosity of about 2400–2800. The pH of the formulation should be between about 7 and 9. At a higher pH, the glitter begins to delaminate. Preferably, the pH is about 7.5–9.0, and most preferably, it is about 8–9.

The formulation temporarily adds a touch of sparkle to practically any machinewashable fabric, and then it washes right out with laundering It gives machine washable fabric a beautiful metallic shimmer or a soft sparkle. The formulation enables consumers to create fashions and crafts quickly and easily. It is especially formulated for use on wearable and home decor fabrics, but it may also be sprayed on plants, flowers, plastics, foam, and paper. Preferably, the components of the formulation comply with the Cosmetic Ingredient Review list so that the formulation may also be sprayed on skin and hair.

From the foregoing, it will be seen that this invention is one well adapted to attain all the ends and objects herein above set forth together with other advantages which are obvious and inherent to the formulation. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth is to be interpreted as illustrative and not in a limiting sense.

I claim:

1. A washable spray formulation, comprising a mixture of:

a solvent that functions as a carrier vehicle;

a first adhesive that is an alkali swellable emulsion; and glitter, wherein said formulation is able to be pumped through a spray pump, wherein said formulation is fabric washable and wherein said first adhesive is present in a sufficient quantity to adhere said glitter to fabric.

2. The formulation of claim 1, wherein said solvent is water, alcohol, or a combination thereof.

3. The formulation of claim 1, wherein said glitter is hexagonal is shape.

4. The formulation of claim 1, wherein said glitter has a thickness of about 1 mil and an effective diameter of about 4 mils.

5. The formulation of claim 1, wherein said glitter is about 1–3% by weight glitter of the formulation.

6. The formulation of claim 1, further comprising:

a second adhesive that is a low molecular weight water-based polymer solution.

7. The formulation of claim 6, wherein said second adhesive is a PVA polymer that is about 70–96% hydrolyzed and has a weight average molecular weight between about 13,000 and 146,000.

8. The formulation of claim 6, further comprising:

one or more components selected from the group consisting of a defoamer, a biocide, a thickener, a surfactant, glycol, an amine solvent, an anticorrosive agent, and an anionic dispersant.

9. The formulation of claim 8, wherein said defoamer is a silicone or silicone-modified compound mineral oil and wherein said surfactant is a phosphate ester surfactant.

10. The formulation of claim 8, wherein said amine solvent is ammonia or an organic solvent with an amine functional group.

11. A spray formulation, comprising a mixture of:

water;

a first adhesive that is an alkali swellable emulsion;

a second adhesive that is a low molecular weight water-based polymer solution;

glitter;

an amine solvent; and a surfactant, wherein said formulation is able to be pumped through a spray pump and wherein said formulation is fabric washable.

12. The formulation of claim 11, wherein said first adhesive is about 3–4% by weight of the formulation, said second adhesive is about 5–10% by weight of the formulation, said amine solvent is about 0.3–0.6% by weight of the formulation, said water is about 75–90% by weight of the formulation, said glitter is about 1–3% by weight of said formulation, and said surfactant is about 0.5–1.5% by weight of the formulation.

13. A method of making a washable spray formulation, comprising:

providing a solvent that functions as a carrier vehicle;

adding a first adhesive that is an alkali swellable emulsion and glitter to said solvent; and mixing said first adhesive, said glitter, and said solvent to form a homogeneous mixture with said glitter evenly distributed throughout, wherein said mixture is a fabric washable spray formulation and wherein said first adhesive is present in a sufficient quantity to adhere said glitter to fabric.

14. A method of applying a spray formulation on a washable fabric, comprising:

providing a container having a pump;

filling said container with a fabric washable spray formulation comprised of a mixture of a solvent that functions as a carrier vehicle, glitter, and a first adhesive that is an alkali swellable emulsion and is present in a sufficient quantity to adhere said glitter to fabric; and spraying said spray formulation on said washable fabric.

15. The method of claim 14, comprising:

laundering said washable fabric, wherein said spray formulation is removed from said fabric.

* * * * *